United States Patent [19]

Dubois

[11] Patent Number: 4,629,218

[45] Date of Patent: Dec. 16, 1986

[54] OILFIELD COIL TUBING

[75] Inventor: Jon D. Dubois, Houston, Tex.

[73] Assignee: Quality Tubing, Incorporated, Houston, Tex.

[21] Appl. No.: 695,953

[22] Filed: Jan. 29, 1985

[51] Int. Cl.[4] ..... F16L 55/00

[52] U.S. Cl. ..... 285/176; 285/177; 166/242; 138/155; 138/177

[58] Field of Search ..... 285/286, 177, 176; 166/242; 138/155, 177, 178, 172, 44

[56] References Cited

U.S. PATENT DOCUMENTS

| | | | |
|---|---|---|---|
| 763,720 | 6/1904 | Campbell | 138/44 |
| 1,870,771 | 8/1932 | De Witt | 285/286 |
| 4,476,923 | 10/1984 | Walling | 166/65 R |
| 4,509,777 | 4/1985 | Walker | 285/286 |

FOREIGN PATENT DOCUMENTS

| | | | |
|---|---|---|---|
| 2556462 | 6/1977 | Fed. Rep. of Germany | 285/177 |
| 16021 | of 1903 | United Kingdom | 138/172 |

*Primary Examiner*—Cornelius J. Husar
*Assistant Examiner*—Anthony Knight
*Attorney, Agent, or Firm*—Arnold, White & Durkee

[57] ABSTRACT

A coil tubing string for injecting fluids into a well includes one or more tapered wall tubing sections welded in series with adjacent straight wall tubing sections to form smooth joints therebetween. The tubing string has tubing sections of dissimilar wall thicknesses. Such tapered wall tubing sections are used to connect tubing sections of dissimilar wall thicknesses wherein the transitions from one tubing section to another is smooth and continuous as one progresses from a thin wall tubing section to a heavy wall tubing section in an ascending order.

34 Claims, 4 Drawing Figures

OILFIELD COIL TUBING

TECHNICAL FIELD

This invention relates generally to oilfield tubing and more particularly, to a flexible coil tubing string including a tapered tubular section having smooth joint connections with adjacent tubing sections making up the string.

BACKGROUND OF INVENTION

Coiled tubing is widely used in the oil and gas industry for completion, production and workover operations. Some of the oilfield operations in which such tubing is used are acidizing, cementing, corrosion control, and downhole nitrogen application. In such operations, the coil tubing is used to transport fluids from the surface down into the well to a predetermined location.

The coil tubing is spooled onto a large reel that is rotatably mounted on a truck. The truck transports the coil tubing on the reel to the field for the injection of fluids into the well. The coil tubing is unwound or played from the reel and is passed into the well through an injector head. The injector head includes a driving mechanism for raising and lowering the coil tubing in the well. The driving mechanism on the injector head forces or drives the coil tubing down into the well and later pulls and lifts the coil tubing from the well to be wound back onto the reel.

In service, the coil tubing may remain suspended in the well for continuous use, and it may extend from the surface to the bottom of the well or to an intermediate point between the surface and the well bottom. The coil tubing may also be temporarily suspended into the well for the duration of a particular operation during which the tubing is often raised and lowered to various levels in the well. Upon completion of the operation, the tubing is spooled back onto the reel to be used for another operation or possibly to be transported to a different location.

Typical fluids that might be injected into the well include acid, corrosion inhibitors, and nitrogen. Such fluids are pumped downhole through the interior of the coil tubing and into the well to perform the particular required operation. The free end of the tubing is connected at the surface by a rotary connection to a pump which in turn communicates with a tank storing the appropriate fluid for the particular operation. The other end of the tubing is forced downhole into the well to allow the injection of the fluids at a predetermined depth.

Historically, in wells having a relatively shallow depth, the coil tubing was straight wall tubing, i.e., tubing having a common inner and outer diameter throughout its length. Many of today's wells now have a depth of 20,000 feet, and it has become desirable to have even deeper wells in order to reach deeper lying hydrocarbon deposits. Thus, it has become necessary to suspend coil tubing 20,000 feet or more downhole. As the length of the straight wall tubing approximates 20,000 feet, the weight of the tubing suspended in the well together with the force required to lift the tubing string in the well may exceed the yield load capacity and the ultimate load capacity of the tubing causing the tubing to fail. For example, the weight of steel tubing, even without a pull force, having a minimum yield of 70,000 pounds per square inch, a minimum ultimate strength of 80,000 pounds per square inch, a nominal outside diameter of 1.25 inches, a nominal wall thickness of 0.109 inches and a density of 490 pounds per cubic foot exceeds its yield load capacity of 27,370 pounds when the total length of the suspended tubing exceeds 20,700 feet. Furthermore, the weight of such tubing exceeds its ultimate load capacity of 31,280 pounds when the total length of the suspended tubing exceeds 23,600 feet. Although it might seem obvious to merely provide a thicker and heavier wall tubing to provide additional yield and load capacities, the thicker and heavier wall only further increases the weight of the tubing and thus does not offer a solution.

The industry's response to this problem is to seek a reduction in the overall weight of the tubing string extending into the well at these great depths. One approach to the reduction of tubing weight is to use a thinner and lighter wall tubing at the lower depths in the well. For example, to reduce tubing weight, thicker or heavier wall tubing is used in the upper portion of the tubing string, as for example the first 3,000 to 4,000 feet of tubing string, and a thinner and lighter wall tubing is used for the lower portion of the tubing string, as for example the lower 15,000 to 16,000 feet. Thus, the yield and ultimate load capacities of the coil tubing are greater in the upper portion of the string where greater yield and ultimate load capacities are required to support the suspended tubing and lower in the lower portion thereof where smaller yield and ultimate load capacities are required since the lower portion supports less tubing string. At the same time, the reduction in the wall thickness results in a reduction in the weight of the suspended tubing.

A tubing string with dissimilar wall thicknesses is formed by welding individual tubing sections formed from tubing strips in ascending order with the thickest wall tubing section at the top, and the thinnest wall tubing section at the bottom. Thus, when the tubing string is lowered into the well, the lowermost tubing section with the thinnest wall is below the tubing section with the next greater wall thickness and so on until the uppermost tubing section has the largest wall thickness whereby the lower tubing sections are thinner and lighter and the upper tubing sections are thicker, stronger and heavier. Each tubing section in the tubing string is designed to withstand the tensile stresses caused by the weight of that portion of the tubing string suspended below.

Because the steel mills are limited by current technology to producing steel strips having a length of approximately 2,000 feet, it becomes necessary to attach multiple sections of coil tubing together to produce a tubing string that will extend into wells having a depth of over several thousand feet. In order to achieve tubing strings such as those which must extend up to 20,000 feet into the well, multiple lengths of tubing sections are welded together. Accordingly, the tubing string is formed by butt welding in series a plurality of tubing sections. Where adjacent tubing sections have a common inner and outer diameter and thus wall thickness, a strong weld is achieved. However, as straight wall tubing has been replaced with a tubing string having tubing sections of dissimilar wall thicknesses the butt-welding of adjacent tubing sections has produced an inferior weld.

The circumferential joint welding process is normally applied to tubular members of approximately equal cross section. The various input parameters in the welding process, such as heat, speed and amount of filler material, are directly related to the thickness of the tubular wall. Problems are encountered in butt-welding tubing sections having dissimilar wall thicknesses because different input parameters are required. Thus, the weld parameters must be compromised to accommodate the dissimilar wall thicknesses. It is well-known that welding two metal sections having different wall thicknesses creates an inferior weld.

In butt-welding two tubing sections of different wall thicknesses to form a tubing string, the outside diameter of the two tubing sections is maintained constant, i.e. they have a common outer diameter. The inside diameter of the two tubing sections, however, is varied to increase the inner diameter of the lower section and to create a thinner tubular wall while the outer diameter is held the same.

In welding a thicker wall tubing to a thinner wall tubing, a step joint is created because the inner diameter of the thicker wall tubing is less than the inner diameter of the thinner wall tubing. This step joint is contrasted to the smooth joint which is formed in butt-welding two adjacent straight wall tubing sections that have the same thickness.

Initially, industry hand welded the step joint, but because the welding resulted in inferior welds, the industry has gone to using an automatic, computerized welding machine. Such automatic welding machines are very expensive; and, even using the automatic welding machines, the compromised welding parameters, due to the varying inside diameters of the step joint prevent achieving a weld comparable to the weld between two straight wall tubing sections.

Upon completion of the butt-welding of two adjacent tubing sections, the joint is given a post heat treatment for metallurgical reasons such as for stress relieving the weld. Such post heat treatment includes applying a wraparound heating coil to the joint and heating the joint to a predetermined temperature for a predetermined period of time. The post heat treatment parameters, which define the proper stress-relieving treatment for the welded joint and include factors such as temperature and time, are dependent upon the wall thicknesses of the joined tubing sections. Similarly, the parameters which define the welding process itself are dependent upon the wall thicknesses of the tubing sections. Heat treatment of tubular walls with a common thickness achieves satisfactory results. However, step joints require heat treatment of dissimilar wall thicknesses theregy causing the post heat treatment to be less than satisfactory. Because the tubular walls have dissimilar thicknesses, each thickness dictates a different set of heat treatment parameters. Thus, where dissimilar wall thicknesses must be heat treated, the parameters for the post heat treatment must be compromised, and the post heat treatment is inferior.

FIG. 2 of the drawings illustrates the prior art step joint. Upper, intermediate and lower tubing sections A, B and C, respectively, are shown butt-welded in series. Although other tubing sections may be welded above and below upper and lower tubing sections A and C, such sections have not been shown for purpose of simplicity. Upper and intermediate sections A and B are shown welded at S1, and intermediate and lower tubing sections B and C are shown welded at S2. The outside diameters of tubing sections A, B and C are all common, i.e., equal and uniform. However, the inside diameters and wall thicknesses of each tubing section are different with the inside diameter increasing and the wall thickness decreasing.

As is clearly shown in FIG. 2 illustrating the prior art, the butt-welds at S1 and S2 create step joints I1 and I2 which are caused by the stepwise, abrupt and non-continuous change of wall thickness and internal diameter. Such step joints are structurally weak and inferior. Thus, the tubing string becomes susceptible to failure at these step joints when forces are applied thereon due to the weight of the suspended tubing string, or when other mechanical and hydraulic forces are applied across the joints.

Step joints cause other serious problems. Since the tubing string must be coiled and uncoiled from the spool, the tubing is subjected to bending moments. It is well-known that upon applying the same bending moment to a stronger member connected to a weaker member, the weaker member will collapse or fail. Thus, as the tubing string is coiled and uncoiled from the spool, bending moments are applied across the step joints in the tubing string such that the mechanical forces due to the bending moments cause the thinner wall tubing to fail.

A further disadvantage of step joints is the application of hydraulic forces to the tubing by the mechanical device on the injector head which raises and lowers the tubing string in the well. This device uses back-to-back hydraulically powered chains having cleats that engage the tubing as the tubing passes between the chains. The hydraulic pressure of the chains can be adjusted to place only that pressure on the tubing which is required to adequately engage the tubing and lift the tubing from the well without the tubing slipping between the chains. However, the pressure on the tubing cannot be so great as to overly compress and thereby collapse the tubing. Thus, the device is designed for adjusting the hydraulic pressure on the chains based upon the length of the tubing in the well and the size and strength of the tubing disposed between the chains. As the tubing string is raised from the well, the weight of the tubing string is reduced since less tubing is suspended; and, therefore, the hydraulic pressure can be reduced. Further, as the wall thickness of the tubing is reduced, the resistance of the tubing to collapse is reduced, and the hydraulic pressure should also be reduced. Thus, as the tubing string is pulled from the well, the hydraulic pressure on the chains is reduced because of the reduced weight of the tubing string and because of the reduced compressive strength of the thinner wall tubing.

The step joint, however, creates an immediate transition from a thick wall tubing to a thin wall tubing. Since the chains engage the tubing over a substantial length as the tubing passes through the device, adjustment of the hydraulic loading for dissimilar sizes of tubing is not possible. Thus, the thin wall tubing is subjected to the same hydraulic load as the thick wall tubing. Under such circumstances, the thin wall tubing may fail under the undue hydraulic pressure.

The structural weaknesses caused by the step joints in the tubing string create other problems. The raising and lowering of the tubing string within the well creates a "yo-yo" effect because of the natural elasticity of the steel tubing string. This "yo-yo" effect places heavy tensile stresses on the string and thus the tubing string may snap at the weak step joints.

Further, varying inernal and external pressures are placed on the tubing string as it is raised and lowered in the well. The tubing string is constantly under both internal and external pressures due to the fluids passing down the string to the bottom of the well and by the well fluids surrounding the tubing string which create a static head that compresses the tubing string. Such head pressures are greatest near the bottom of the well. Where the differential pressure across the tubing is great, and particularly when applied to the step joint, the tubing string can fail at the joint. Further, as the tubing string is raised and lowered in the well, the tubing string encounters both internal and external pressure changes which when applied to the weak step joint, can cause the step joint to break.

The injection fluids passing through the tubing string are under pressure. As the injection fluids travel across a step joint, turbulence is created because the inner tubular wall is unsmooth. Such turbulence tends to cause the fluids to eat away at the wall of the tubing just past the step joint and may cause the tubing to fail. This has become more critical as better grades of tubing have become available since better tubing has permitted an increase of the pressure of injection fluids. Now it is possible to use pressures in the order of magnitude of 10,000 PSI. As this pressure is increased, the turbulence caused by step joints is further increased thereby enhancing the problem.

Needless to say, if the tubing string fails and a portion thereof drops down into the well, a fishing operation is required to retrieve the broken tubing string out of the well. Such fishing operations are very expensive and time consuming.

Although these deficiencies of the prior art are particularly acute when the tubing string exceeds a length of 20,000 feet, it may be desirable to reduce the weight of the tubing string in more shallow wells, such as wells of approximately 10,000 feet in depth. Even at such depths, the mechanical device raising and lowering the tubing string must still place substantial pressure on the tubing to raise and lower the string. Even a tubing string of approximately 10,000 feet in length has substantial weight whereby the hydraulic forces applied by the mechanical device in raising and lowering the string could break the tubing. If tubing of greater strength is used to overcome the problem, such tubing may be too stiff and not have sufficient bending capability to coil the tubing onto the spool. Thus, it may be advantageous to use lighter tubing strings even in a more shallow well by using a tubing string comprised of tubing sections with dissimilar wall thicknesses.

There are other reasons for using thin wall tubing together with thick wall tubing besides weight reduction. Thin wall tubing allows the use of certain downhole tools and also permits the custom design of the tubing string for a particular well where it is anticipated that certain pressures will be encountered by the tubing string at particular depths. For example in some cases, the pressure differential between the internal and external pressures of the tubing string is not as great at the bottom of the well as it is at the surface and thus it may be advantageous to have thin wall tubing making up the lower portion of the string where less strength is required.

The present invention overcomes the aforementioned deficiencies of the prior art by providing a coil tubing string that includes tubing sections with varying wall thicknesses to achieve weight reduction and also eliminates the structurally weak step joint and inferior weld. The tubing string of the present invention includes continuous inner and outer walls with smooth joints between adjacent tubing sections. Such smooth joints are accomplished by using tapered tubing sections having a tapering internal wall with an inner diameter that increases in a progressive, continuous, and smooth fashion from one end to the other. Each end of the tapered section has a wall thickness equal in inner and outer dimension to that of the adjacent tubing section such that step joints are eliminated. Thus, a smooth wall is formed throughout the tubing string while achieving an ascending magnitude of strength from the lower end of the string to the surface. No stepwise, abrupt or non-continuous changes of wall thickness or strength occur. Since the strength and structural integrity of the smooth joints are enhanced by the common wall thicknesses at the welds and the transition from one wall thickness to another occurs over a substantial length, structural failures are greatly reduced.

Various tapered conduits have been used for other applications in the prior art. For example, U.S. Pat. No. 3,152,458 discloses a drill pipe, usually 30 feet in length, having a tapered portion extending between a lower heavy wall portion connected to lower heavy drill collars and an upper heavy wall portion connected to the drill pipe string extending to the surface.

Other objects and advantages of the present invention appear from the following description.

SUMMARY OF THE INVENTION

The present invention includes a smooth and uniform inner wall tubing string having one or more tapered tubing sections welded to adjacent tubing sections so as to form smooth joints therebetween. The tapered tubing section includes an upper end having a wall thickness equal to that of the adjacent upper tubing section, and a lower end having a wall thickness equal to the wall thickness of the adjacent lower tubing section whereby upon welding the tapered tubing section to the adjacent upper and lower tubing sections, the weld is of two equal wall thicknesses such that uniform input welding parameters and post heat treatment parameters may be used to form a strong joint. Thus, smooth joints and a progressive, continuous and smooth inner tubular wall throughout the length of the tubing string are achieved.

Depending upon the depth of the well, one or more tapered tubing sections may be used in the tubing string. Each tubing section is sized so as to permit smooth joints on each end, i.e., the ends having a wall thickness equal to adjacent tubing sections. It is preferred that in most applications the tubing sections of different wall thicknesses be connected in ascending order such that the thinner wall sections are located near the bottom of the well, and the stronger heavy wall sections are located near the top of the well.

The use of tapered tubing sections to eliminate abrupt changes in wall thickness in the tubing string does not only increase the strength of the welds but also, it provides a transition in dissimilar wall thicknesses that occurs over a substantial length of the tubing string, as for example at least a few feet, whereby neither the hydraulic forces of the mechanical lifting device nor the bending moments from the spooling are applied across an abrupt change in wall thickness such as occurs in the step joint of the prior art.

BRIEF DESCRIPTION OF THE DRAWINGS

For a detailed description of the preferred embodiments of the invention, reference will now be made to the accompanying drawings, wherein.

DESCRIPTION OF THE PREFERRED EMBODIMENTS

In the description which follows, it should be understood that the drawings are not to scale and some proportions have been exaggerated in order to more clearly depict certain features of the invention.

Figure 1:
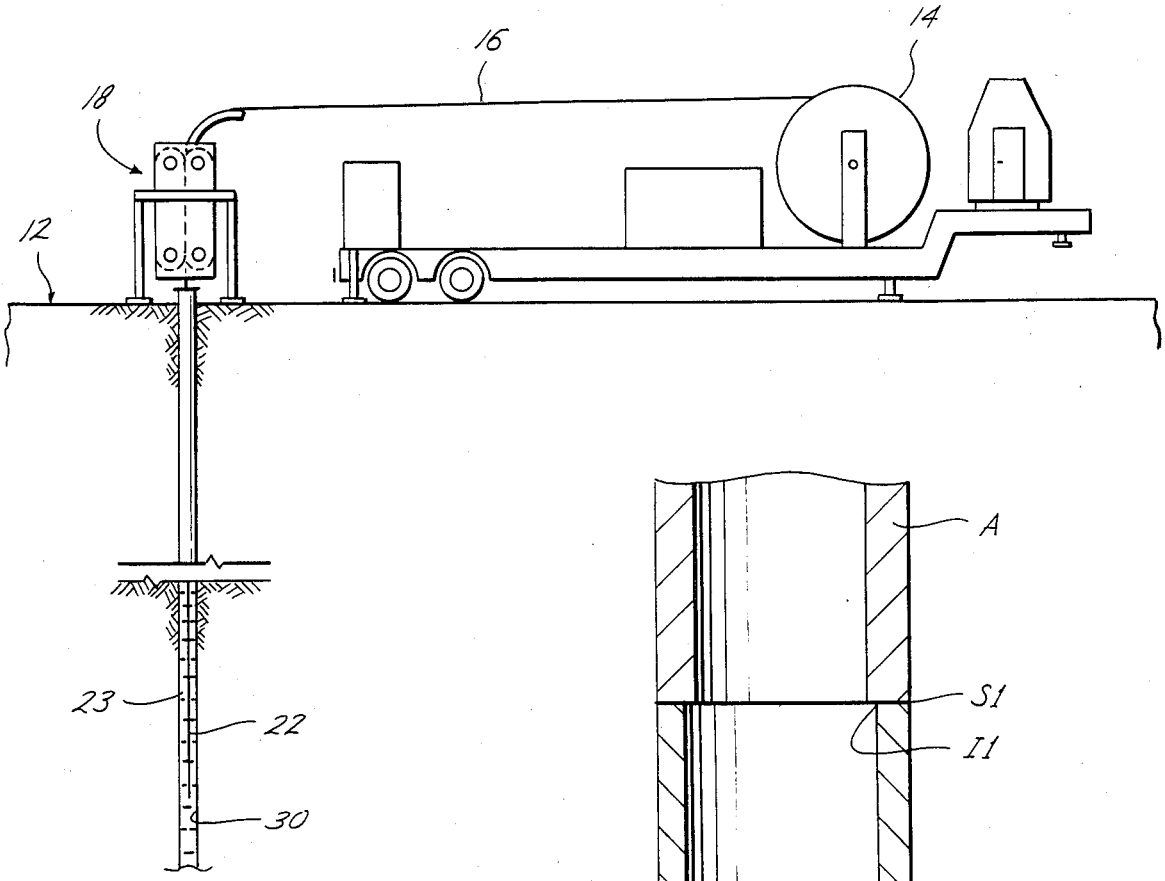
FIG. 1 shows a perspective view illustrating a length of flexible coil tubing suspended downhole.

Referring now to FIG. 1, there is shown a typical application for the use of a flexible coil tubing string in the oilfield. The coil tubing string 16 is shown spooled onto a large reel 14 rotatably mounted on the back of a truck or trailer, such as the Bowen Tools, Inc. 30MB Tubing Injector System Bobtail Truck Mounting shown on Page 1106 of the 1984–1985 *Composite Catalog of Oilfield Equipment and Services.* The truck transports coil tubing string 16 and reel 14 to a well site 12 where coil tubing string 16 is to be used to inject fluids down into bore-hole 22 of well 12. An injector head 18, such as the Bowen Tool, Inc. 30MB injector head or the Coil Tubing and Nitrogen Service, Inc. injector head, shown at pages 1105 and 6030, respectively, in the 1984–1985 *Composite Catalog of Oilfield Equipment and Services,* is shown mounted on the wellhead. Injector head 18 includes a mechanical device for raising and lowering tubing string 16 in well 12. Coil tubing string 16 is shown unwound or played from reel 14 and passed through injector head 18 into well 12. Tubing string 16 is gradually played out or unwound from reel 14 and is simultaneously forced downhole and into borehole 22 by injector head 18. Subsequently upon completion of the operation, tubing string 16 may be retrieved and removed from well 12 using injector head 18 to raise tubing string 16 and using reel 14 to wind tubing string 16 back onto reel 14 by reverse rotational movement.

Depending upon the service, tubing string 16 may be suspended in well 12 either permanently for continuous service as for example in production operations or temporarily for a particular stimulation operation. An example of the use of the coil tubing is continuous service for a production operation is disclosed in U.S. Pat. No. 4,476,923, incorporated herein by reference. Operations of a temporary nature using coil tubing in stimulation operations are disclosed at pages 1105, 2040, and 6030 of the 1984–1985 *Composite Catalog of Oilfield Equipment and Services,* incorporated herein by reference.

In operation, the free end of coil tubing string 16 is suspended in borehole 22 and is surrounded by well fluids 23 in annulus 30. Typically coil tubing string 16 is used to inject liquids or gases, such as acid, corrosion inhibitors or nitrogen, into the well and are pumped downhole through the interior of coil tubing string 16 to perform a particular operation. The other end of tubing string 16 is connected to a pump (not shown) and a tank (not shown) which supplies the appropriate fluid for the operation. The pumping of the fluids down through tubing string 16 creates internal pressures on the interior of the tubing. As previously indicated, external pressures are placed on the tubing as the result of the hydrostatic head caused by the well fluids 23 present in annulus 30 around tubing string 16. Thus, tubing string 16 is exposed to various internal and external pressures depending upon its depth in the well and the pump pressures applied to the injection fluid.

Although the present invention is described being utilized in a stimulation operation, it should be clearly understood that the present invention may be used in production operations such as that disclosed in U.S. Pat. No. 4,476,923. The use of coil tubing in place of threaded production tubing has many advantages in certain types of oil and gas wells, particularly where the tubing must be removed often from the well.

Flexible coil tubing string 16 of the present invention includes a plurality of individual tubing sections butt-welded together, there being a sufficient number of sections of given length to provide tubing string 16 with sufficient length to extend from the surface to a predetermined depth downhole in the well. For example, a tubing string for a well 20,000 feet in depth may be made up of ten tubing sections butt-welded together.

Although coil tubing string 16 may be made up of any combination of straight wall tubing sections and tapered wall tubing sections, one typical combination includes one or more straight wall tubing sections making up the upper portion of the tubing string 16, a tapered wall tubing section welded to the end of the lowermost of the upper straight wall tubing sections, another straight wall tubing section connected to the bottom of the tapered wall tubing section having a thinner wall than the upper straight wall tubing sections, and a second thinner wall tapered tubing section below the thin, straight wall tubing section.

Figure 3:
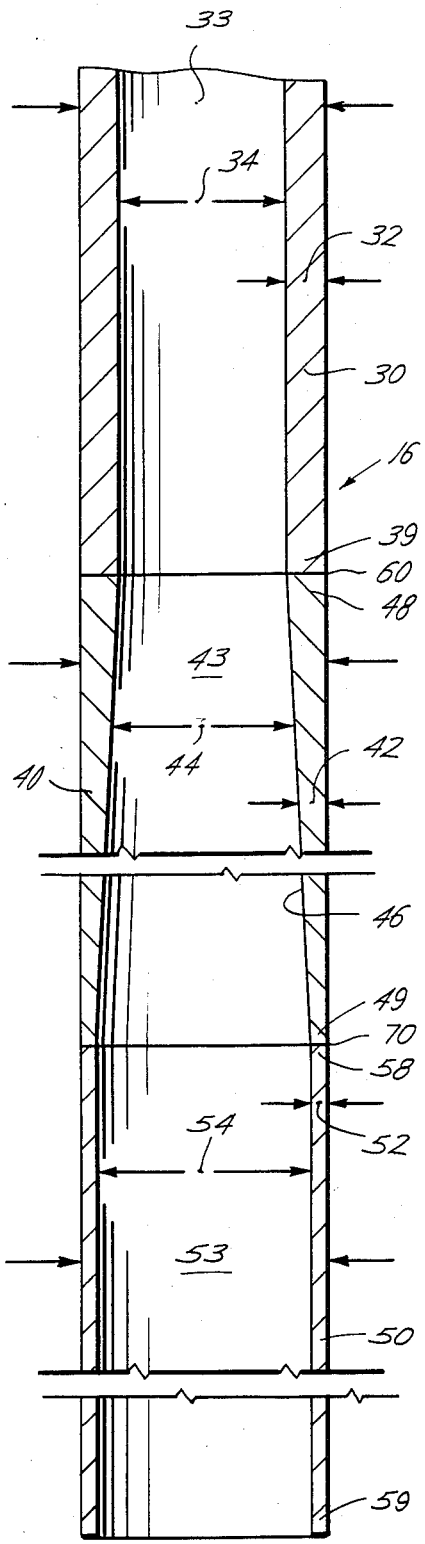
FIG. 3 shows a longitudinal sectional view of the flexible coil tubing of FIG. 1 illustrating the preferred embodiment of the present invention.

Referring now to FIG. 3 illustrating a preferred embodiment of the present invention, three of the individual flexible coil tubing sections of the plurality of sections making up tubing string 16, are shown. These tubing sections include a heavy wall upper tubing section 30, a tapered wall intermediate tubing section 40, and a thin wall lower tubing section 50. Lower tubing section 50 is the lowest of the three making up the tubing string when tubing string 16 is suspended in the well. In this combination, upper tubing section 30 includes a heavy wall 32 having sufficient strength to support all tubing sections suspended therebelow. The outside diameter 33, inside diameter 34, and the thickness of wall 32 of upper tubing section 30 are uniform throughout its entire length. Likewise, the outside diameter 53, inside diameter 54 and the thickness of wall 52 of lower tubing section 50 are uniform throughout its length. Thus, upper and lowing tubing sections 30, 50 may be termed "straight wall" tubing sections. Wall 52 of lower tubing section 50 is thinner than heavy wall 32 of upper section 30 since lower section 50 will not be required to support as much suspended weight. Also, lower tubing section 50 is sufficiently sized to withstand the internal and external pressures exerted thereon.

In contrast to straight wall tubing sections 30, 50, intermediate tubing section 40 may be termed a "tapered wall" tubing section. Although the outside diameter 43 of intermediate section 40 is the same as outside diameters 33 and 53 of sections 30,50, the inside diameter 44 and the thickness of wall 42 of intermediate section 40 will vary along its length. The inner tubular surface of wall 46 will taper radially outward to form what might be described as an elongated, truncated internal cone. Thus, intermediate tubing section 40 is different from upper and lower tubing sections 30, 50 in that the internal surface 46 of wall 42 tapers with respect to the flow axis as contrasted with the internal surfaces of walls 32 and 52 which are parallel with the flow axis. It is preferred that the taper on the interior of taper tubing section 40 taper in a smooth, continuous and progressive manner from upper end 48 to lower end 49 of section 40.

Figure 2:
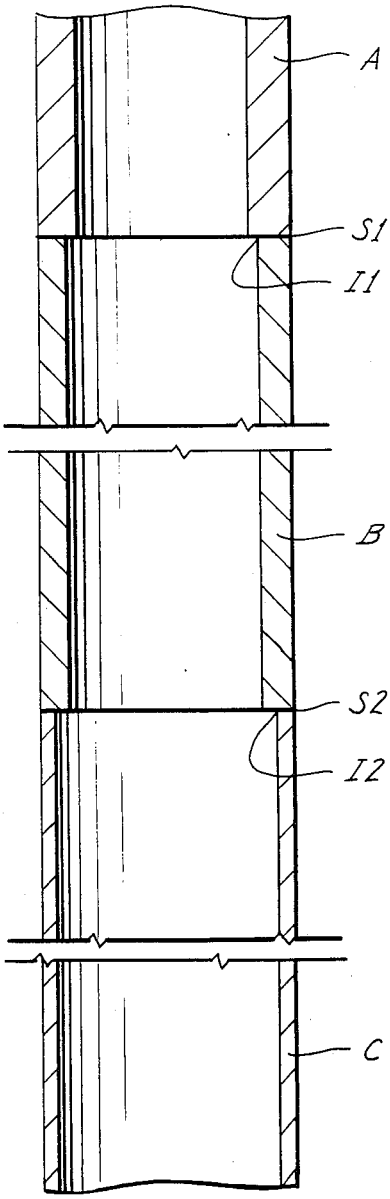
Fig. 2 PRIOR ART
FIG. 2 shows a longitudinal sectional view of the flexible coil tubing of the prior art.

Upper end 48 is butt-welded at 60 to the lower end 39 of heavy wall section 30. Likewise, lower end 49 of tapered section 40 is butt-welded at 70 to the upper end 58 of thin wall section 50. To achieve smooth joints and eliminate any step joint, the thickness of wall 42 equals the thickness of wall 32 at upper end 48 and equals the thickness of wall 32 at its lower end 49. Similarly, the inside diameter 44 at upper end 48 equals the inside diameter 34 of heavy wall section 30 and inside diameter 44 at lower end 49 equals the inside diameter 54 of thin wall section 50. Thus, it can be seen that by butt-welding the ends of tapered section 40 to adjacent tubing sections having common end dimensions, smooth joints may be achieved. The step-wise, abrupt and non-continuous welded splices causing step joints, as taught by the prior art illustrated in FIG. 2, are eliminated and are replaced by welded splices and smooth joints that are of superior strength. The smooth joints are not as susceptible to failure due to the optimization of the welding process as compared to the process for welding dissimilar wall thicknesses and the transition from a thin to a thicker section is smoother whereby failures observed in the prior art caused by the bending movements and the hydraulic gripping and pulling mechanism of injector head 18 are eliminated.

The coil tubing of the present invention is flexible and preferably made of steel or similar material. Each straight wall tubing section is manufactured at the mill from a steel strip of appropriate dimensions. Typically, the straight wall tubing sections such as sections 30 and 50 have a nominal outside diameter ranging from 0.75 to 1.50 inches and a length ranging from 2,000 to 3,000 feet. Furthermore, although various gauges of steel may be used for the tubing wall, currently available nominal wall thicknesses for the straight wall sections are 0.067, 0.075, 0.087, 0.095, and 0.109 inches resulting in a weight in the range from 0.5 pounds to 1.5 pounds per foot of straight wall tubing. Furthermore, although various strength steels may be used, steel having a minimum yield strength of 70,000 pounds per square inch and a minimum ultimate strength of 80,000 pounds per square inch is typically used. However, it should be understood that the advantages of the present invention may still be obtained using flexible straight wall tubing sections having different dimensions and characteristics than the aforementioned including a length of even a few feet.

Each tapered tubing section such as section 40 is manufactured from a continuous tapered strip of steel or similar material. Typically, the tapered tubing sections have a length between 1,500 and 4,500 feet, a wall thickness between 0.067 and 0.109 inches and a nominal outside diameter between 0.75 and 1.50 inches. The strength of the steel used for the tapered strips of the present invention may vary depending upon the strength of the steel required for the particular application. Typically, however, steel having a minimum yield strength of 70,0000 pounds per square inch and a minimum ultimate strength of 80,000 pounds per square inch is used.

Although the length of the tapered section is preferably in the range of several thousand feet, lengths in the range of 1,500 to 4,500 feet are primarily used because of their convenience in the manufacturing process. However, the length of the tapered section such as section 40 may be substantially shorter and is only dictated by the need for a transition length between two tubing sections having dissimilar wall thicknesses. The tapered tubing sections need to be long enough to create smooth joints with adjacent tubing sections and to permit an appropriate transition length through the mechanical device of injector head 18 for raising and lowering tubing string 16. Furthermore, the length of the tapered tubing section such as section 40 should be great enough to avoid failure caused by the application of the bending moments in coiling and uncoiling string 16 onto reel 14. Thus, it is possible that tapered tubing section 40 may have a length of a matter of inches up to a length limited only by the production process for tubing strips used in the manufacturing of tubing sections. It is only important that the tubing section have a sufficient length to permit a smooth well joint; to have a sufficient transition length to permit the even application of hydraulic pressure by the injector head; and to have a sufficient transition length to withstand the bending moment of the coiling of the tubing string onto the reel. Such objectives may be accomplished by having a tubing section with a length substantially less than 2,000 feet.

The taper of each tapered tubing section such as section 40 normally will occur over the entire length of the tapered tubing section. It can be seen, however, that the taper may occur over any change in wall thicknesses between the ends of the tubing section. Furthermore, the taper may extend from one gauge steel at the upper end of the tubing section to the next lower gauge steel or to any other lower gauge steel at its lower end by varying the degree of tapering and/or the length of the tapered section to connect two sections of different wall thicknesses as discussed hereinabove.

For purposes of illustration only, in the embodiment shown in FIG. 3, the dimensions for heavy wall tubing section 30 are a uniform nominal outside diameter 33 of 1.0 inch and a uniform nominal thickness of 0.087 inches for wall 32. Lower thin wall tubing section 50 also has a nominal outside diameter 53 of 1.0 inch and a nominal thickness 0.067 inches for wall 52. As previously described, tapered section 40 also has a uniform nominal outside diameter along its entire length of 1.0 inch but will have a tapered inside diameter. Upper end 48 has a nominal wall thickness of 0.087 inches, common to that of upper section 30, and a nominal wall thickness at lower end 49 of 0.067 inches, common to the thickness of wall 52 of lower section 50.

Figure 4:
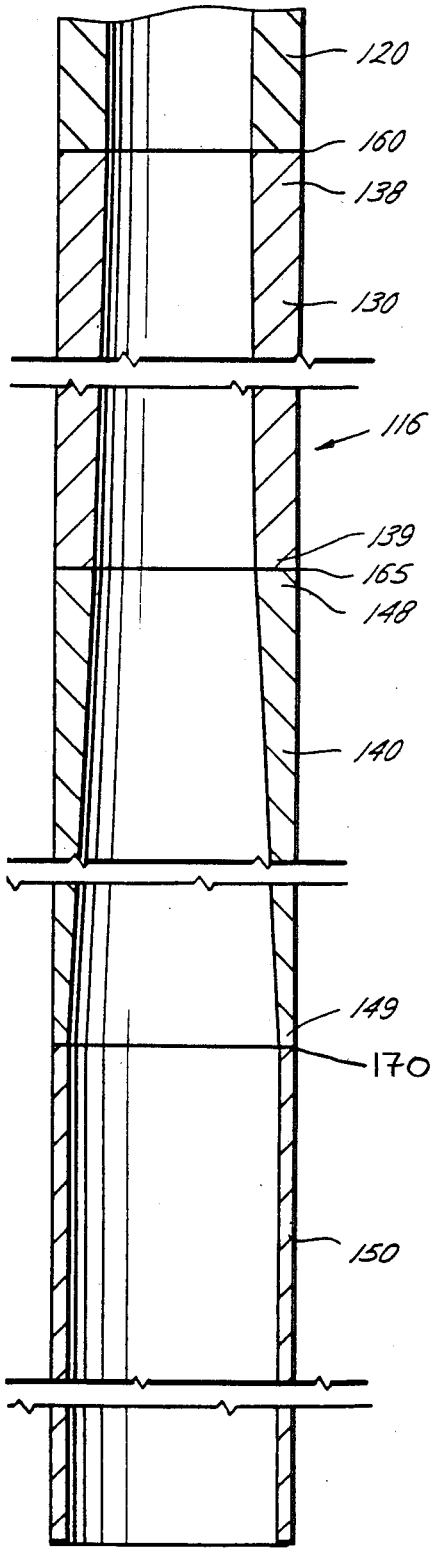
FIG. 4 shows a longitudinal sectional view of an alternative embodiment of the flexible coil tubing shown in FIG. 3.

Referring now to FIG. 4, there is shown another combination of tubing sections making up the flexible coil tubing string 116. In this embodiment of the invention,, two tapered tubing sections are disposed between two straight wall tubing sections. The coil tubing string 116 of FIG. 4, includes an uppermost straight wall tubing section 120, an upper tapered tubing section 130, a lower tapered tubing section 140 and a lowermost straight wall tubing section 150.

Lower tapered tubing section 140 and lowermost straight wall tubing 150 are comparable to tapered tubing section 40 and lower straight wall tubing section 50 shown in FIG. 3. The lower end 149 of lower tapered section 140 has the same wall thickness as the wall of lower straight wall tubing section 150. The weld between sections 140 and 150 create smooth joint 170.

Likewise, uppermost straight wall tubing section 120 and upper tapered wall tubing section 130 are comparable to sections 30 and 40 of FIG. 3 although the dimensions are different. The upper end 138 of upper tapered tubing section 130 has a wall thickness equal to the wall thickness of uppermost straight wall tubing section 120. The butt-weld connecting sections 120, 130 thereby forms a smooth joint 160 to provide a smooth and continuous inner tubular surface.

As distinguished from the embodiment of FIG. 3, FIG. 4 illustrates the connection of two tapered tubing sections 130, 140. The lower end 139 of upper tapered section 130 is butt-welded to the upper end 148 of lower tapered section 140 to form a smooth joint 165 therebetween. The wall thicknesses of lower end 139 and upper end 148 are the same at the weld of smooth joint 165. The taper of tapered section 130 and 140 may be designed to be the same or may vary for sections 130 and 140.

The result achieved is a smooth and continuous inner tubular surface throughout the length of tubing string 116. As is now clearly shown, two or more tapered tubing sections may be combined to achieve any length of tapered tubing that may be required for a particular application. It is certainly within the scope of this invention that the entire tubing string may be tapered from one end to the other, all having smooth joints between connecting tapered tubing sections.

In the embodiments of FIGS. 3 and 4 the tubing has the same minimum yield and ultimate strengths throughout its entire length whereby the yield and ultimate load capacities only change as the wall thickness of the tubing changes. Therefore, the yield and ultimate load capacities change smoothly as the wall thickness changes from a low magnitude at the bottom to a large magnitude at the top. In the embodiment shown in FIG. 3, for example, the minimum and ultimate yield strengths are the same throughout the entire tubing string 16. Therefore, the yield and ultimate load capacities of tubing section 50 are constant throughout its entire length. The yield and ultimate load capacities, however, of tapered tubing section 40 increase as the thickness of wall 42 increases from end 49 to end 48. Similarly, the yield and ultimate load capacities of section 30 are constant throughout its entire length. It should be understood that the yield and ultimate load capacities of tapered section 40 at lower end 49 are equal to the yield and ultimate load capacities of section 50 because the wall thickness 42 at end 49 is equal to the wall thickness 52 of section 50. Similarly, the yield and ultimate load capacities of section 40 at upper end 49 are equal to the yield and ultimate load capacities of section 30. Therefore, the yield and ultimate load capacities change smoothly as the wall thickness changes smoothly. Similarly, the yield and ultimate load capacities of tubing string 16 change smoothly in the tubing sections (not shown) that are above section 30 as the wall thickness of such sections change smoothly as discussed hereinabove with respect to the embodiment of FIG. 3.

For purposes of illustration only, in the embodiment of FIG. 3, sections 30, 40 and 50 have a minimum yield and ultimate strength of 70,000 and 80,000 pounds per square inch, respectively, that are constant throughout tubing string 16. Furthermore, for the dimensions referred to hereinabove for purposes of illustration, the yield and ultimate load capacities of section 50 are 13,720 and 15,040 pounds respectively, throughout the entire length of section 50. The yield and ultimate load capacities of section 30 are 17,500 and 20,000 pounds, respectively, throughout the entire length of section 30. The yield load capacity of section 50 ranges from 13,720 pounds at lower end 49 to 17,500 pounds at upper end 48. Similarly, the ultimate load capacity of section 50 ranges from 15,040 pounds, at lower end 49, to 20,000 pounds, at upper end 48.

It should be understood, however, that in the embodiments of FIGS. 3 and 4, the minimum yield strength at some or all sections of the tubing string may vary smoothly and continuously along the flow axis by appropriate manipulation of the cooling and rolling process at the steel mill in forming the straight and the tapered wall sections whereby the yield load capacity of the tubing string may change accordingly with or without a change in wall thickness. In the embodiment shown in FIG. 3, for example, section 50, having a uniform wall thickness, may be constructed accordingly to have a minimum yield strength that increases smoothly and continuously along the flow axis from the lower end 59 to the upper end 58 whereby the yield load capacity thereof increases accordingly. Furthermore, tapered tubing section 40 may be constructed accordingly to have a minimum yield strength that increases smoothly and continuously along the axis thereof from the lower end 49 to the upper end 48 whereby the yield load capacity increases accordingly not only because the wall thickness of section 40 increases but, also, because the minimum yield strength thereof increases also. It should be noted that the minimum yield strength of the lower end 49 of section 40 should be equal to the minimum yield strength of the upper end 58 of section 50 in order to have a smooth transition from section 50 to section 40 in terms of yield load capacity. Furthermore, section 30 may be constructed accordingly to have a constant minimum yield strength along the axis thereof. It should be noted, also that the minimum yield strength of section 30 at the lower end 39 should be equal to the minimum yield strength of section 40 at the upper end 48 to accomplish a smooth transition from section 30 to section 40 in terms of yield load capacity. Similarly, the tubing sections above section 30 may be constructed accordingly to provide tubing 16 having a yield load capacity that increases smoothly along the axis thereof without incurring stepwise, abrupt and noncontinuous transitions from section to section not only in terms of wall thickness, but also, in terms of yield load capacity.

For illustration purposes only, in FIG. 3, the minimum yield strength of section 50 might be 50,000 pounds per square inch at lower end 59 and 60,000 pounds per square inch at upper end 58. Furthermore, the minimum yield strength of section 40 might be 60,000 pounds per square inch at lower end 49 and 70,000 pounds per square inch at upper end 48. Furthermore, the minimum yield strength of section 30 might be 70,000 pounds per square inch throughout the entire length thereof.

While preferred embodiments of the present invention have been shown and described, modifications thereof can be made by one skilled in the art without departing from the spirit of the invention. For example, it should be understood that the present invention is not limited to the configurations shown in FIGS. 3 and 4; different configurations may be used with tubing sections of tapered walls and straight walls welded in series accordingly, so that, a smooth and continuous transition from one tubing section to another adjacent tubing section may be accomplished. Furthermore, it should be understood that a single tapered tubing section may constitute the entire flexible coil tubing string if the length requirement deems it feasible. Furthermore, it should be understood that one may deviate from the tapered shape of the wall thickness utilizing other geometrical configurations such as a slightly curved configuration or the like to accomplish a smooth and continuous transition from one tubing section to another. Furthermore, it should be understood that the application of the present invention is not limited to the oil and gas industry but may be utilized in other applications wherein flexible coil tubing is used.

I claim:

1. Well tubing for providing fluid communication between the surface and a preselected location in a well, comprising:

an elongated coilable cylindrical member having a length defined by a first end supportable at the surface of said well and a second end positionable at a preselected location in said well, said elongated cylindrical member being provided with a flow passageway to place said first end in fluid communication with said preselected location in said well;

said elongated cylindrical member having a substantially constant outer diameter along its entire said length and an inner diameter that increases smoothly from said first end to said second end; and support means for supporting said elongated cylindrical member in said well solely by suspending said first end of said elongated cylindrical member, said cylindrical member being unsupported from immediately below said support means to said second end.

2. Well tubing for providing fluid communication between the surface and a preselected location in a well, comprising:

a plurality of elongated, coilable cylindrical members joined end-to-end, each of said elongated cylindrical members having a length defined by a first end and a second end, each of said elongated cylindrical members containing a smooth flow passageway throughout its length defined by an inner diameter, said flow passageway in at least one of said cylindrical members expanding smoothly from said first end to said second end;

each of said elongated cylindrical members having substantially the same constant outer diameter along its entire length;

said elongated cylindrical members arranged and joined end-to-end to form said well tubing such that the flow passageway through each said joint is a continuous, smooth flow passageway;

said well tubing being suspendible in a well solely by suspending an uppermost said cylindrical member at said surface of said well; and said plurality of cylindrical members being further arranged and joined so that any selected cylindrical member is no heavier than any other cylindrical member of substantially the same length positioned closer to said surface of said well than said selected cylindrical member.

3. The well tubing according to claim 2 wherein said inner diameter of said plurality of said elongated cylindrical members increases uniformly from said first end of each said cylindrical member to said second end of each said cylindrical member.

4. The well tubing according to claim 3 wherein only ends having substantially the same inner diameters are joined.

5. The well tubing according to claim 2 wherein said cylindrical members are joined in said end-to-end arrangement by a circumferential weld to provide a weld joint with substantially the same ultimate load capacity as a said cylindrical member having the same inner diameter as the inner diameter of said weld joint.

6. The well tubing according to claim 2 wherein each said cylindrical member has a length substantially greater than its outer diameter.

7. The well tubing according to claim 2 wherein each said elongated cylindrical member is formed from high yield-strength metallic material, the minimum ultimate yield-strength of said well tubing increasing as said inner diameter of said elongated cylindrical members decreases.

8. A method of providing fluid communication between the surface of a well and a preselected location within a well, comprising the steps of:

producing a plurality of spoolable, elongated tubular members, each having a length defined by a first end and a second end, each said tubular member having a similar outer diameter along its said length, at least one of said elongated tubular members having a constant inner diameter defining a flow passageway from its respective said first end to its respective said second end, at least one of said elongated tubular members having an inner diameter defining a flow passageway increasing in diameter from its respective said first end to its respective said second end;

positioning a plurality of said tubular members together end-to-end so that said first end of each said elongated tubular member abuts a said second end of a said tubular member having a similar inner diameter, thereby forming a continuous tubing string having an upper end and a lower end;

further positioning said plurality of elongated tubular members so that any selected tubular members is no heavier than any other tubular member of equal length located nearer to said first upper end of said tubing string;

joining together said ends of said elongated tubular members when so positioned so that said tubing string defines a continuous, smooth flow passageway from said upper end to said lower end of said tubing string;

spooling said tubing string onto a reel, beginning with said upper end of said tubing string;

introducing said lower end of said tubing string into said well;

spooling said tubing string off of said reel to insert said tubing string into said well until said lower end of said tubing string is positioned at a preselected depth in said well;

suspending said inserted tubing string in said well solely by suspending a portion of said tubing string at said surface of said well.

9. The method according to claim 8 wherein said first end and said second ends having substantially the same inner diameters are joined together by a circumferential welding operation.

10. The method according to claim 8 wherein each said elongated cylindrical member is formed with a length substantially greater than its outer diameter.

11. The method according to claim 8 wherein each said elongated cylindrical member is formed from high yield-strength metallic material.

12. The method according to claim 11 wherein the minimum ultimate yield-strength of any given section of said tubing string is greater than any section of said tubing string of equal length positioned closer to said second lower end of said tubing string.

13. The method according to claim 8 wherein said tubing string is at least twenty thousand feet long.

14. The method according to claim 8 wherein said inner diameter of at least one of said tubular members increases along a portion of said tubular member.

15. The method of claim 8 including the step of supplying fluid through said upper end of said tubing string to provide fluid communication to said well at said preselected depth.

16. The method of claim 15 including the steps thereafter of gripping said tubing string at said surface of said well and lifting said tubing string to remove said string from said well; and spooling said tubing string onto said reel as said tubing string is removed from said well.

17. A method of providing fluid communication between the surface of a well and a preselected location within a well, comprising the steps of:

producing a plurality of elongated cylindrical members, each said member having a length defined by a first end and a second end, each said cylindrical member having a similar outer diameter along its said length, at least one of said elongated cylindrical members having a constant inner diameter defining a flow passageway from its respective said first end to its respective said second end, at least one other of said elongated cylindrical members having an inner diameter defining a flow passageway increasing in diameter from its respective said first end to its respective said second end;

positioning a plurality of said elongated cylindrical members together end-to-end so that the inner diameter of said first end of each said cylindrical member abuts said second end of the adjoining cylindrical member, thereby forming a continuous tubing string having an upper end and a lower end;

arranging said plurality of elongated cylindrical members so that a number of cylindrical members, each having a constant similar inner diameter, form said upper end of said tubing string;

arranging said plurality of elongated cylindrical members so that a number of said cylindrical members, each having an inner diameter constantly increasing from each said first end to said second end, form the middle section of said tubing string, said cylindrical members being arranged so that the smallest inner diameter of said middle section is nearest to said upper end of said tubing string while the largest inner diameter of said middle section is nearest to said lower end of said tubing string;

arranging said plurality of elongated cylindrical members so that a number of said cylindrical members, each having a constant similar inner diameter, form said lower end of said tubing string, said inner diameter being larger than the said inner diameter of said cylindrical members forming said upper end of said tubing string, said inner diameter further being substantially the same as the said largest inner diameter of said middle section of said tubing string;

joining said adjoining first and second ends of said elongated cylindrical members together so that a continuous flow passageway is formed from said upper end to said lower end of said tubing string;

spooling said tubing string onto a reel, beginning with said upper end;

introducing said lower end of said tubing string into said well;

spooling said tubing string off of said reel;

inserting a length of said tubing string into said well until said lower end of said tubing string is positioned at a preselected depth in said well;

suspending said inserted length of said tubing string in said well solely by suspending a portion of said tubing string at said surface of said well;

supplying said flow passageway with fluid through said first upper end of said tubing string to provide fluid communication to said well at said preselected depth;

gripping said tubing string at said surface of said well and lifting said tubing string to remove said string from said well; and spooling said tubing string onto said reel as said tubing string is removed from said well.

18. The method according to claim 17 wherein said first ends and said second ends having substantially the same inner diameters are joined together by a circumferential welding operation.

19. The method according to claim 17 wherein each said elongated cylindrical member is formed with a length substantially greater than its outer diameter.

20. The method according to claim 17 wherein each said elongated cylindrical member is formed from high yield-strength metallic material.

21. The method according to claim 17 wherein said tubing string is at least twenty thousand feet long.

22. The method according to claim 17 wherein the interior wall of said tubing string forms a substantially smooth surface from said first upper end to said second lower end.

23. A method of making a tubing string for use in a well to provide fluid communication between the surface and a downhole location in the well which comprises:

producing a plurality of sections of tubing having the same outside diameter but wherein at least on such section has an inside diameter which tapers from a relatively larger diameter at a first end to a smaller diameter at its second end, at least one such section may have a constant inside diameter along its length, no two separate sections which have tapered inside diameters have matching inside diameters at both ends, and no two separate sections which have constant inside diameters may have matching inside diameters;

connecting said sections together end-to-end such that each said section having a tapered inside diameter will be positioned in said string with its first end lower than its second end and such that said sections will be arranged in the well with their inside diameters becoming progressively larger down the well; and selecting and arranging said sections in said string such that the connecting ends of adjacent sections in the string have the same inside diameter and wall thickness.

24. The method of claim 23 in combination with the step of coiling said string at the surface of the earth.

25. The method of claim 24 in combination with the steps of uncoiling the coiled string and feeding the uncoiled string down the well.

26. The method of claim 25 in combination with the step of suspending said uncoiled string in the well from the surface.

27. A tubing string, defined by a first end, a second end, and at least one intermediate section positioned between said first end and said second end, adapted to be suspended in a well, comprising:

a plurality of coilable tubing sections adapted to be connected end-to-end to form said tubing string, said sections having substantially the same outside diameter;

at least one said section in said tubing string having an inside diameter which tapers from a relatively smaller diameter at its upper end when positioned in a well to a larger diameter at its lower end;

each remaining said section having a constant inside diameter throughout its length; and each said intermediate section in said string having the same inside diameter and wall thickness at its upper end as the inside diameter and wall thickness of the lower end of the tubing section, if any, immediately above said intermediate section, said intermediate section also having the same inside diameter and wall thickness at its lower end as the inside diameter and wall thickness of the upper end of the tubing section, if any, immediately below said intermediate section.

28. The tubing string defined in claim 27 wherein said string is in coiled form at the surface of the earth.

29. The tubing string defined in claim 28, in combination with a drum rotatable about a central axis in one direction to coil said string on said drum and in the opposite direction to uncoil said string from said drum.

30. The tubing string defined in claim 29 in combination with a feed mechanism adapted to receive uncoiled string from said drum and to feed said string down the well.

31. The tubing string defined in claim 27 including means at the surface of the earth to suspend said string in a well.

32. Apparatus for providing fluid, communication between the earth's surface and a location down a well comprising:

a string of tubing adapted to be suspended in a well with a first end of the string at the surface and the second end down the well;

said string having a constant outside diameter along its length and an inside diameter which tapers down the well at least once to a larger inside diameter and smaller wall thickness;

said string being sufficiently flexible to be coiled at the surface; and each said taper being over a length of said string sufficient to inhibit failure of said string due to bending moments.

33. The apparatus defined in claim 32 in which said inside diameter tapers at a plurality of locations spaced along said string and each successive taper down the well increases the inside diameter of the string to a progressively larger diameter and decreases the wall thickness to a progressively smaller wall thickness.

34. A method of providing fluid communication between the surface of a well and a preselected location within a well, comprising the steps of:

producing a plurality of elongated cylindrical members, each said member having a length defined by a first end and a second end, a similar outer diameter along its said length, and an inner diameter defining a flow passageway increasing in diameter from said first end to said second end;

positioning a plurality of said cylindrical members together end-to-end so that the inner diameter of said first end of any given cylindrical member abuts a second end of a said cylindrical member having a similar inner diameter, thereby forming a continuous tubing string having an upper end and a lower end with said first end of said cylindrical members facing said upper end of said tubing string;

arranging said plurality of elongated cylindrical members so that any selected cylindrical member weighs less than any other cylindrical member of equal length located nearer to said first upper end of said tubing string;

joining the abutting pairs of said first and second ends of said elongated cylindrical members together so that a continuous, smooth flow passageway is formed from said upper end to said lower end of said tubing string;

spooling said tubing string onto a reel, beginning with said upper end;

introducing said lower end of said tubing string into said well;

spooling said tubing string off of said reel;

inserting a length of said tubing string into said well until said lower end of said tubing string is positioned at a preselected depth in said well;

suspending said inserted length of said tubing string in said well solely by suspending a portion of said tubing string at said surface of said well;

supplying said flow passageway with fluid through said upper end of said tubing string to provide fluid communication to said well at said preselected depth;

gripping said tubing string at said surface of said well and lifting said tubing string to remove said string from said well; and spooling said tubing string onto said reel as said tubing string is removed from said well.

* * * * *